US008840273B2

(12) United States Patent
Sooferian

(10) Patent No.: US 8,840,273 B2
(45) Date of Patent: Sep. 23, 2014

(54) ADJUSTABLE FOCUS LIGHT

(71) Applicant: Danny H Sooferian, Camarillo, CA (US)

(72) Inventor: Danny H Sooferian, Camarillo, CA (US)

( * ) Notice: Subject to any disclaimer, the term of this patent is extended or adjusted under 35 U.S.C. 154(b) by 0 days.

(21) Appl. No.: 13/762,061

(22) Filed: Feb. 7, 2013

(65) Prior Publication Data

US 2013/0208481 A1 Aug. 15, 2013

Related U.S. Application Data

(60) Provisional application No. 61/597,044, filed on Feb. 9, 2012.

(51) Int. Cl.

| | |
|---|---|
| ***F21V 14/06*** | (2006.01) |
| ***F21V 14/04*** | (2006.01) |
| ***F21V 14/02*** | (2006.01) |

(52) U.S. Cl.

CPC ..... *F21V 14/06* (2013.01); *F21V 14/04* (2013.01); *F21V 14/02* (2013.01)

USPC ..... 362/280; 362/281

(58) Field of Classification Search

USPC ..... 362/280

See application file for complete search history.

(56) References Cited

U.S. PATENT DOCUMENTS

| | | | | |
|---|---|---|---|---|
| 4,716,402 | A * | 12/1987 | Francis | 340/546 |
| 4,987,523 | A * | 1/1991 | Lindabury et al. | 362/188 |
| 6,877,876 | B1 * | 4/2005 | Steinhilber | 362/188 |
| 2005/0083687 | A1 * | 4/2005 | Brass et al. | 362/231 |
| 2009/0091925 | A1 * | 4/2009 | Hesse et al. | 362/187 |

* cited by examiner

*Primary Examiner* — Mary Ellen Bowman

(74) *Attorney, Agent, or Firm* — Colin P. Abrahams

(57) ABSTRACT

A light fixture comprises a lens frame, a lens on the lens frame and a light source. The lens and light source are movable relative to each other between a first position in which the lens and the light source are nearer each other and a second position in which the lens and light source are further away from each other, wherein light produced by the light fixture is more focused or more diffuse according to the relative positions of the lens and the light source.

14 Claims, 11 Drawing Sheets

ADJUSTABLE FOCUS LIGHT

CROSS-REFERENCES TO RELATED APPLICATIONS

This application claims the benefit of U.S. Provisional Patent Application No. 61/597,044 filed Feb. 9, 2012, the contents of which are incorporated herein by reference in their entirety.

FIELD AND BACKGROUND OF THE INVENTION

This invention relates to an adjustable focus light or lamp. More particularly, the invention is for a lamp or light fixture which can be adjusted so as to selectively provide either a more focused beam to illuminate a smaller area, or a less focused beam to provide more general area lighting.

SUMMARY OF THE INVENTION

According to one aspect of the invention, there is provided a light fixture comprising a lens frame, a lens on the lens frame and a light source, the lens and light source being movable relative to each other between a first position in which the lens and the light source are nearer each other and a second position in which the lens and light source are further away from each other, wherein light produced by the light fixture is more focused or more diffuse according to the relative positions of the lens and the light source. In various embodiments: the lens is movable and the light source is stationary; the light source is movable and the lens is stationary; and both the lens and the light source or movable relative to each other.

In one embodiment, there is further provided a reflector for reflecting the light of the light source, which may be either movable or stationary.

In one form of the invention, the lens is mounted in a lens frame, and the lens frame is movably mounted to a light housing, the light source being mounted on the light housing. The lens frame may be mounted on a substantially cylindrical housing upon which the light source is mounted, the lens frame telescoping with respect to the cylindrical housing to facilitate an increase or decrease in the distance between the light source and the lens. In other embodiments, the lens frame may engage a housing in or upon which the light source is mounted.

The lens frame may have a handle portion which can be manipulated by the user to move the lens in the lens frame closer to or further from the light source, or it may comprise a rotatable handle, the rotatable handle having an end which engages in a recess formed within the lens frame.

In another embodiment, the light fixture comprises a shaft at least partially threaded and is formed within a housing of the light fixture, the shaft being connected to an adjusting knob at one end thereof, the shaft being connected to one of the light source, lens or reflector or at another end thereof.

According to another aspect of the invention, there is provided a method of making a light fixture comprising mounting a lens frame having a lens and a light source relative to each other, the lens and light source being movable relative to each other between a first position in which the lens and the light source are nearer each other and a second position in which the lens and light source are further away from each other, wherein light produced by the light fixture is more focused or more diffuse according to the relative positions of the lens and the light source.

According to yet a further aspect of the invention, there is provided a method of adjusting the focus of a beam in a light fixture comprising the steps of mounting a lens frame having a lens and a light source relative to each other, and moving the lens and light source relative to each other between a first position in which the lens and the light source are nearer each other and a second position in which the lens and light source are further away from each other, wherein light produced by the light fixture is more focused or more diffuse according to the relative positions of the lens and the light source.

The light in accordance with the present invention may be used either indoors or outdoors. Moreover, the light may be powered in a conventional fashion through use of an AC outlet or using the battery, or it may be powered by solar energy, especially when located outdoors, and may be positioned so as to advantageously capture and use solar power. Moreover, the lamp or light fixture may be powered by a combination of any one of the above.

The invention therefore, in one aspect, may comprise a light source mounted within a housing, and an adjustable lens associated with the light source so that the light emanating from the light source can be focused or unfocused to provide different forms or effects of light and illumination. When unfocused, the light from the light source may typically provide general flood lighting for illuminating a larger area, and when focused, the light from the light source may provide spotlighting or directed lighting in order to illuminate a smaller and a more specific area.

In another aspect of the invention, it is the light source itself that may be adjustable, so as to move nearer to or further away from the lens to focus the light emanating therefrom in a variety of different manners.

In yet a further aspect of the invention, the light fixture may further compromise a light reflector associated with the light source, and the light reflector may be adjustable so as to move nearer to or further away from the light source itself, or the lens, or both.

It is further within the scope of the present invention that two or more of the light source, lens and reflector may be movable relative to each other so as to permit the capability of focusing the light emanating from the light fixture in the desired fashion.

The housing of the lamp or light fixture may include reflective means, such as a mirror, for reflecting and enhancing upon the amount of light which may be produced by the light fitting. The reflective means may be movable, as described above, and may be of any suitable shape or dimension. Further, the reflective means may be comprised of two or more components which may move relative to each other to differently reflect the light from the light source, thereby allowing different degrees of focusing. The reflective means, or its components where applicable, may also be resilient or malleable so as to assume different shapes.

The adjustable lens, light source or reflector may take many different forms, and may be positioned relative to each other in a variety of different manners and embodiments. For example, the adjustable lens may be fixed within a frame or bracket, the frame or bracket being adjustably connected to the remainder of the light fixture so that movement thereof will adjust and vary the focus of the light beam produced.

It should be noted that the adjustable lens, the light source or the reflector may be positioned at any point between the focused and unfocused location so that any desired form of light which may fall between the flood lighting and spotlighting extremes can be achieved. Therefore, small adjustments to the position of the lens, light source and or reflector are possible, and either one or more of these components may be fixed to the housing in a manner whereby each or more than one will be securely positioned at the desired point to provide the preferred light, without moving or shifting under normal conditions.

In one embodiment, the frame or bracket in which the lens, light source or reflector is contained may be threaded and connected to the housing around the light source. In another embodiment, the frame or bracket may be mounted so that it can slide or telescope forward and backward relative to the light source, lens or reflector to provide the desired beam.

In another form of the invention, the lens and the frame in which it is contained may have a mechanism whereby the position of the lens can be easily adjusted, such as by a handle, knob, or other physical mechanism. Such adjustment may be possible in certain embodiments by placing the adjustment mechanism outside of the housing so that it can be easily accessed. Additionally, the lens (or another of the components controlling focus) may be adjustable by a motor, and, in one form of the invention, the motor may be remotely operable so that the position of the lens can be adjusted without having to be right at the light fitting itself.

The invention therefore provides a mechanism for lighting which can vary between a spotlight providing a narrow beam of light and a floodlight which provides a wider beam of light. A mix of the two also fall within the scope of the invention. In various embodiments, the light source moves, the lens moves, or and optional reflector may move, or combination thereof may move, to provide the desired effect.

There may be a single light source, which is preferably an LED, or a plurality of light sources. The different LEDs may have different angles of deflection. Further, each of the light sources or LEDs may be mounted independently of each other and may be independently adjustable. For example, if there are two light sources, both may be in the focused mode, both may be in the wide beam mode, or one may be focused and the other wide beam. In another example, there may be three light sources, all independently movable, and each light source may be differently focused, such as wide beam, narrow beam, and intermediate beam. It will be appreciated that there are many different combinations and permutations within the scope of the invention.

In one embodiment, a single dial or other controller may simultaneously move the lens in one direction and the light source in another direction.

DETAILED DESCRIPTION OF THE DRAWINGS

Reference is now made to the attached drawings which illustrate a lens, lens frame, reflector and a light fitting constructed with a lens of the present invention. It is to be noted that the present invention may constitute the lens itself, which may be associated with a lens frame, independent of the light fitting, and which may be selectively placed on the light fitting. The present invention also covers the light fitting with a lens or lens and frame attached thereto.

It is a feature of the invention that any one of the lens, light source or reflector when present, when associated with the light fitting is movable relative to the light source of the light fitting, and is located on the light fitting in a position adjacent to or near this light source. In this specification, any reference to or description of the movability of the lens should be understood to mean that corresponding embodiments may be provided in which the light source and/or reflector are similarly or correspondingly movable instead of, or in addition to, the lens, or the reflector and light source respectively.

In one embodiment, the lens is movable from a first position in which it is closer to the light source such that light from the light source is diffused or dispersed at least to some extent so as to provide general lighting or flood lighting. The lens is movable from the first position to a second position wherein the lens is situated further from the light source such that light from the light source is more focused into a more concentrated beam so that a spotlight is provided, whereby a more specific target or area can be illuminated. Furthermore, the lens may be located anywhere between the first and second positions so that the light from the light source may have varied focus according to the selected position.

Therefore, the lens is not confined to being in either the first or the second position. The lens may be also located at any point which is intermediate these two positions or extremes, so that a light beam or lighting effect of the desired type may be achieved by selecting any intermediate position for the lens. This desired type of light may be anything between the range of a focused spotlight and a more generally diffused floodlight, as already described.

Some of the attached drawings illustrate mechanisms by means of which the lens and its lens frame (or, correspondingly, the light source at its base or the reflector and its base)

can be associated with the light fitting in a manner which will facilitate the movement between the first and second positions. There are many different ways of constructing the lamp and associated lens to permit the relative movement therebetween. The examples provided in the present application are not intended to be limiting, but only exemplify the broad range and nature of such construction which will fall within the scope of the invention.

Figure 1:
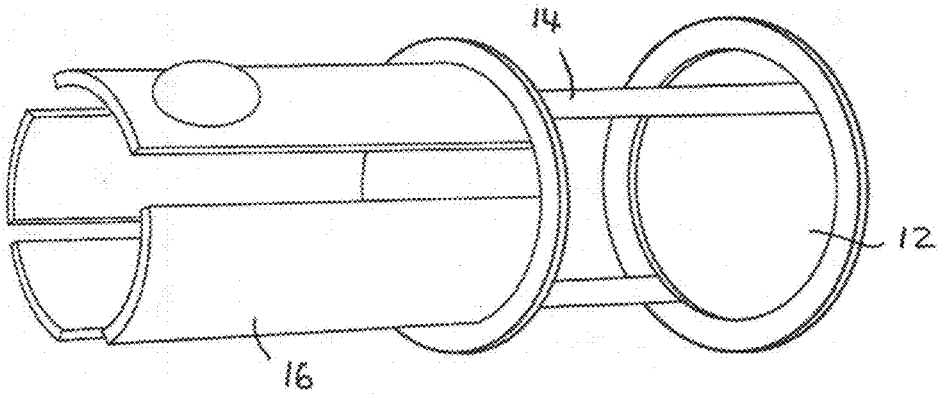
FIG. 1 is a perspective view of a lens and frame in accordance with one aspect of the invention.

In FIG. 1 of the drawings, there is shown a lens 12 held in a lens frame 14. The lens frame 14 attaches to a frame mount 16, which is connectable to a light fixture such that the light source of the light fixture will be adjacent the lens 10. The frame mount 16 slides in a slot designed therefor, and can be moved axially so as to shift the position of the lens 12 relative to the light source, not shown in FIG. 1, to thereby move nearer to or further away from the light source. Such movement of the lens 12 will focus the light emanating from the light source in different ways so as to achieve a more concentrated beam or a more diffuse light, as mentioned above.

Figure 2A:
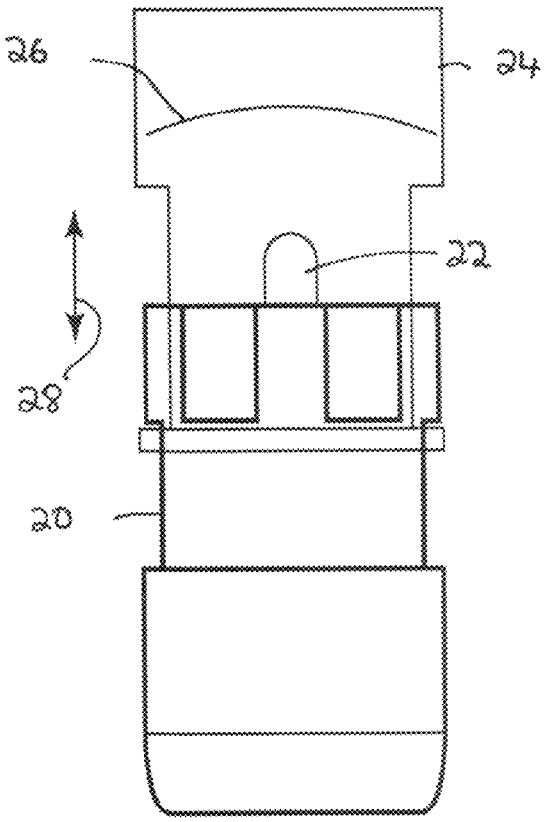
FIGS. 2A and 2B are side views of a lens and frame shown in a light fixture, in different positions with respect to the light source.
Figure 2B:
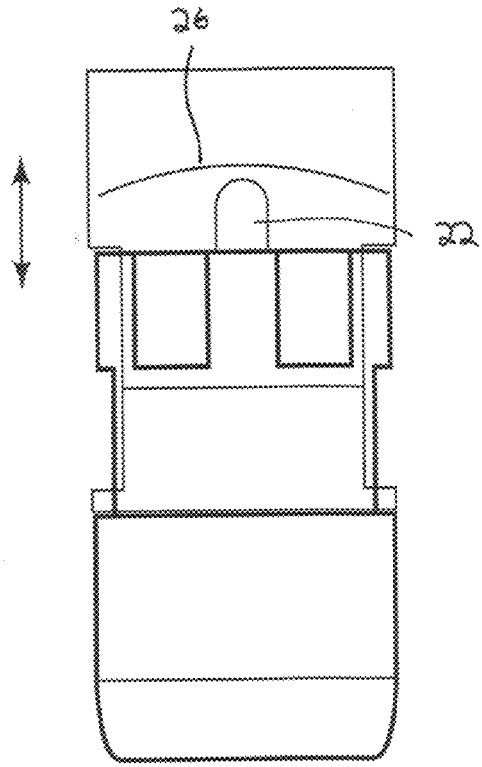

FIGS. 2A and 2B of the drawings show a light fixture 20 including a light source 22. The light fixture 20 receives a lens frame 24, which is able to slide over the designated portion of the light fixture 20. The lens frame 24 includes lens 26. FIG. 2A of the drawings shows the lens frame 24 in the position where the lens 26 is furthest away from the light source 22, while FIG. 2B shows the lens frame 24 in the position where the lens 26 is closest to the light source 22. The arrow 28 illustrates the axial movement of which the lens frame 24 is capable, and the lens frame 24 can of course be located at any position intermediate the extremities of those respectively shown in FIGS. 2A and 2B of the drawings.

Figure 3:
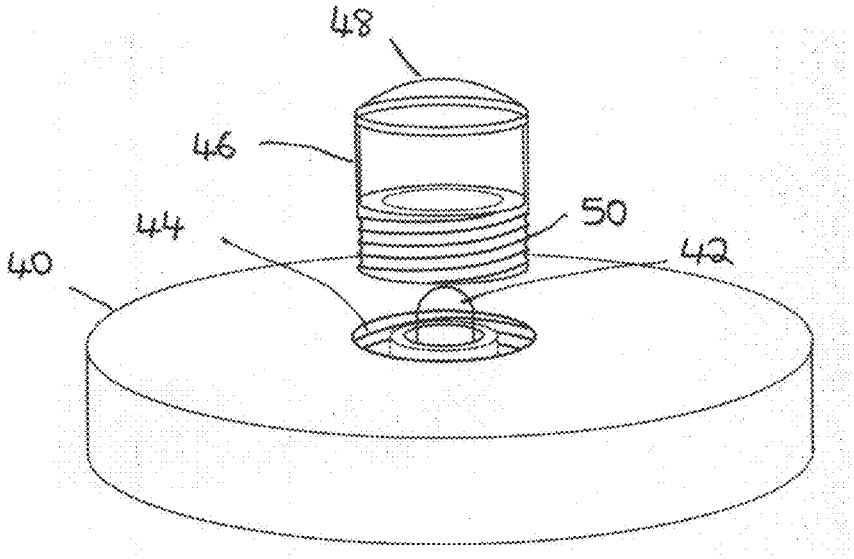
FIG. 3 is a perspective view of a lens, frame and part of a light fitting in accordance with another aspect of the invention.

FIG. 3 of the drawings shows a further embodiment of the invention including a light fixture 40 having a light source 42. The light fixture 40 is somewhat disk shaped. Around the light source 42 there is a threaded well 44. A lens frame 46 including a lens 48 is provided, the lens frame 46 including a lower threaded portion 50. The lower threaded portion 50 is received within the threaded well 44 and secured therein. Depending on how far into the threaded well 44 the lens frame 46 is screwed, the distance of the lens 48 from the light source 42 will vary, so that the focus of the light emanating from the light source can be more beam like, more diffuse and general, or something between these ranges.

Figure 4:
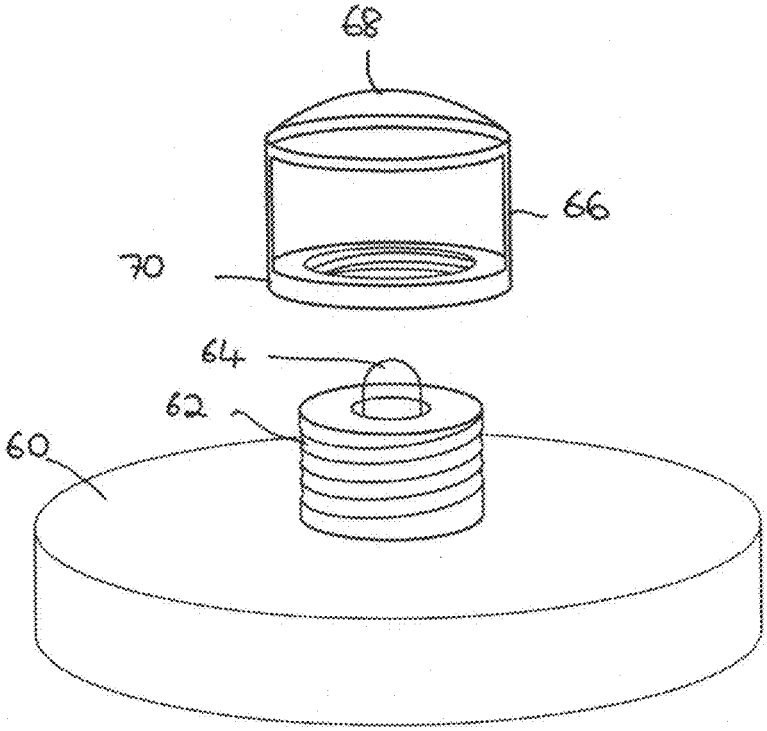
FIG. 4 is a perspective view of a lens, frame and part of a light fitting in accordance with yet a further aspect of the invention.

FIG. 4 of the drawings shows another light fixture with lens in accordance with the invention. A light fixture 60 of generally flat disk shape has extending from the upper surface thereof a threaded cylindrical portion 62. At the top of the cylindrical portion 62, there is located a light source 64. A frame 66 including a lens 68 and a base portion 70 is mounted on the cylindrical portion 62. The base portion 70 has thread corresponding to that on the cylindrical portion 62, so that appropriate rotation of the frame 66 on the cylindrical portion causes engagement therebetween. Furthermore, the extent to which the frame 66 is screwed onto the cylindrical portion 62 will determine the distance between the light source 64 and the lens 68. As already described, different distances between the lens 68 and the light source 64 will result in a change in the nature of the manner in which light is dispersed from the light fixture. Appropriate adjustment will therefore facilitate light dispersion between a more focused beam and a more general diffusion of light, as described.

Figure 5A:
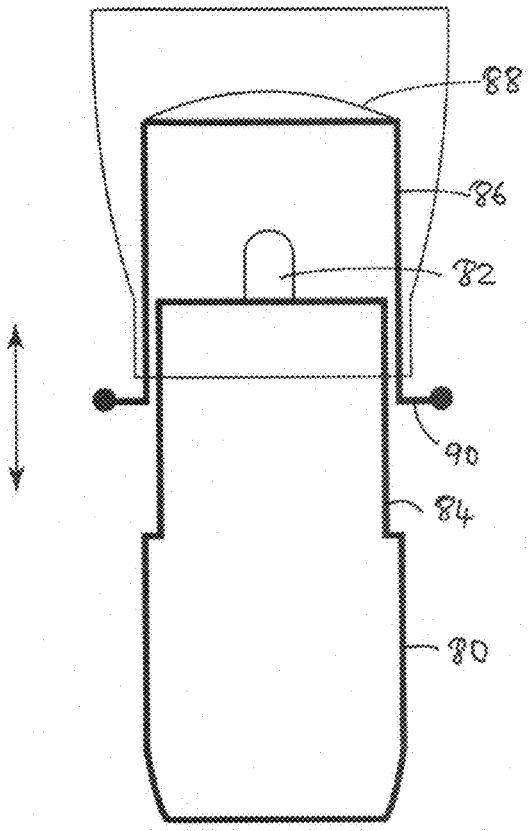
FIGS. 5A and 5B are side views of a lens and light fitting in accordance with a different embodiment of the present invention.
Figure 5B:
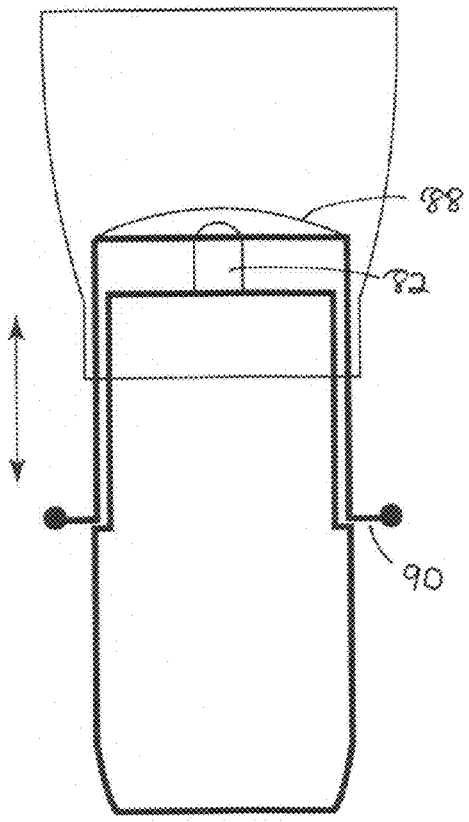

FIGS. 5A and 5B of the drawings show a further embodiment of the invention. A light fixture 80 including a light source 82 is provided. The light fixture 80 has a slightly narrower portion 84, which accommodates a lens frame 86 including a lens 88. The lens frame 86 has an upper portion in which the lens 88 is received, a mid-portion of generally cylindrical shape which straddles the narrower portion 84 of the light fixture 80, and a radially outwardly extending handle 90. As will be appreciated from a comparison of FIGS. 5A and 5B, the handle 90 may be manipulated to move the lens 88 away from the light source 82, as shown in FIG. 5A, or towards the light source 82 as shown in FIG. 5B. Once more, the lens 88 may be positioned relative to the light source 82 at any intermediate distance by appropriately manipulating the handle 90 and locating the lens frame 86 at the desired distance from the light source 82. In this way, a beam of light or diffuse light, or something therebetween, may be achieved.

Figure 6A:
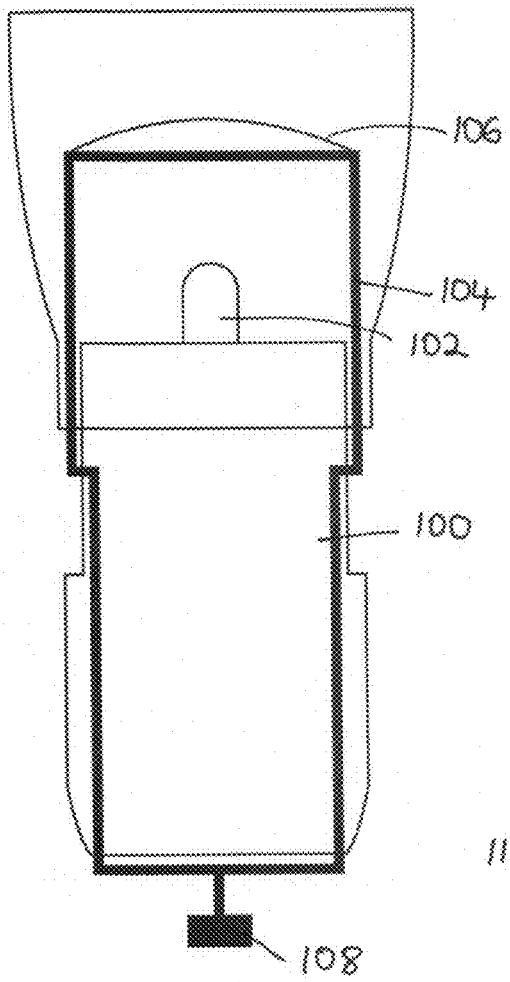
FIGS. 6A and 6B show a lens frame fitted to a light fitting in accordance with yet a further embodiment of the present invention.
Figure 6B:
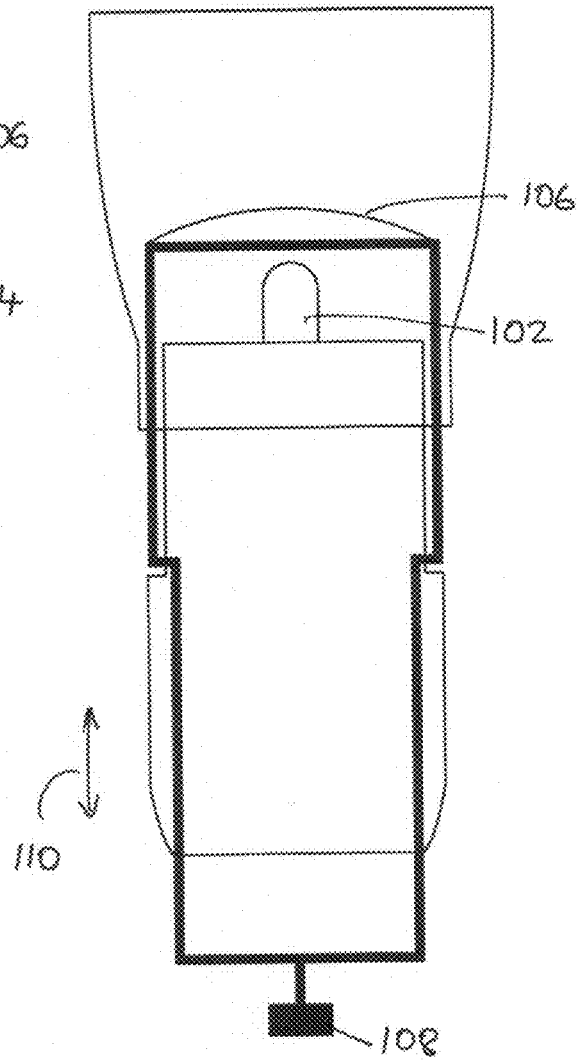

FIGS. 6A and 6B show yet a further embodiment of the invention. There is provided a light fixture 100 having a light source 102. A lens frame 104 surrounds the light fixture 100, and has at its upper end a lens 106. At the opposite end, the lens frame 104 includes a handle 108, and the pulling and pushing of the handle 108 causes axial movement of the lens frame 104 to move the lens 106 toward or away from the light source 102. This effect is illustrated in these figures of the drawings, where FIG. 6A shows the lens 106 distanced from the light source 102, and where FIG. 6B shows the lens 106 much nearer the light source 102. The arrow 110 illustrates the direction of axial movement of the lens frame 104, achieved by appropriate manipulation of the handle 108. Once more, the embodiment shown in these figures may provide a light fixture which selectively provides a more focused beam or a more diffuse light which emanates therefrom, or something in between, as desired by the user.

Figure 7A:
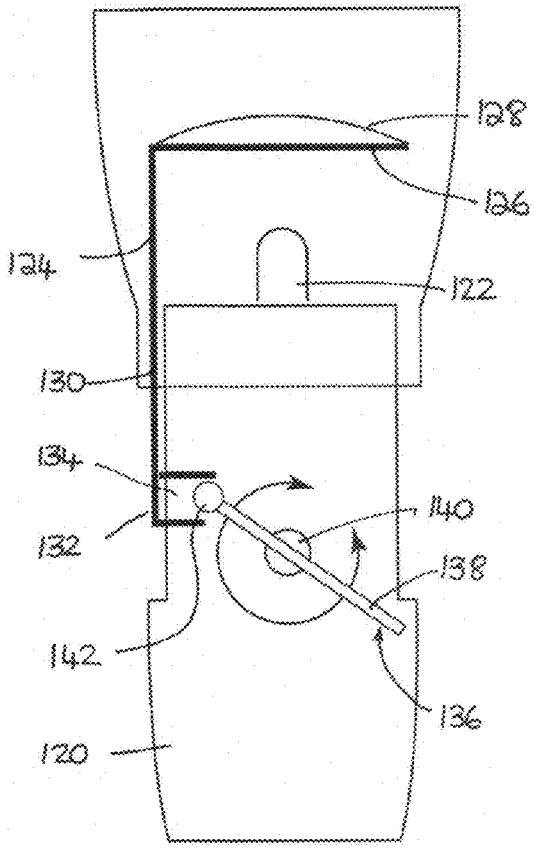
FIGS. 7A and 7B show a lens frame attached to a light fitting in accordance with a still further embodiment of the present invention.
Figure 7B:
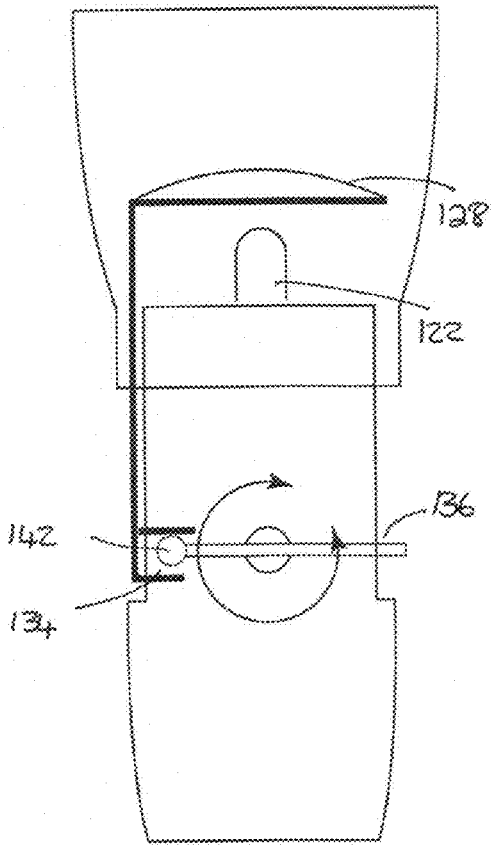

FIGS. 7A and 7B show yet a further embodiment of the invention, illustrating a light fixture 120 having a light source 122. A frame lens 124 is provided, and comprises an upper bracket 126 which supports a lens 128, an arm 130, and a base portion 132 which defines a space 134. On the body of the light fixture 120, there is provided an adjustment lever 136 consisting of a rotatable arm 138 mounted about a pivot 140. The end 142 of the rotatable arm 138 engages in the space 132. Appropriate rotation of the rotatable arm 138 causes the lens frame 124 to move axially up and down, toward and away from the light source 122 respectively. FIG. 7A shows a configuration where the lens 128 is spaced a distance away from the light source 122, while FIG. 7B shows the configuration where the lens 128 is closer to the light source 122. The lens may be located at any point therebetween. This is accomplished by turning the rotatable arm 138 about the pivot 140 until the lens 128 is at the desired distance from the light source 122 to provide the type of light as desired.

Figure 8A:
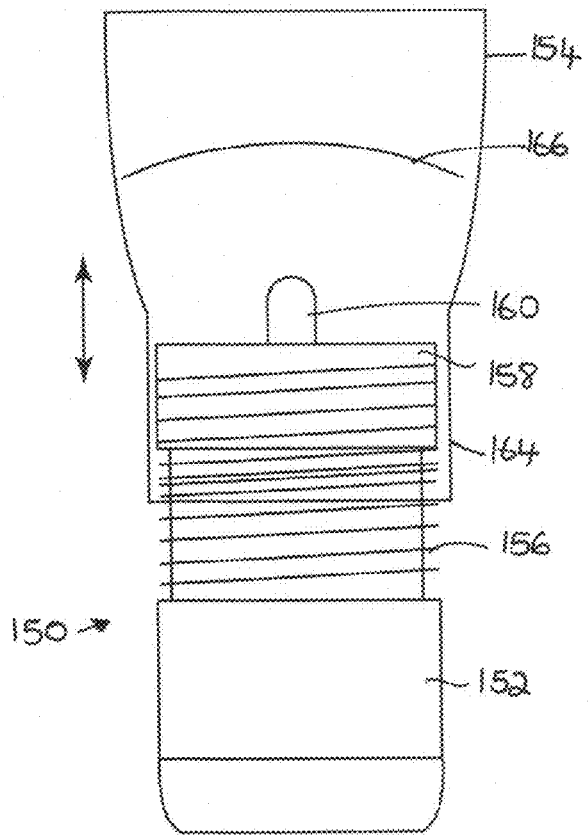
FIGS. 8A and 8B show yet another embodiment of the invention for providing a lens and frame onto a light fixture or fitting.
Figure 8B:
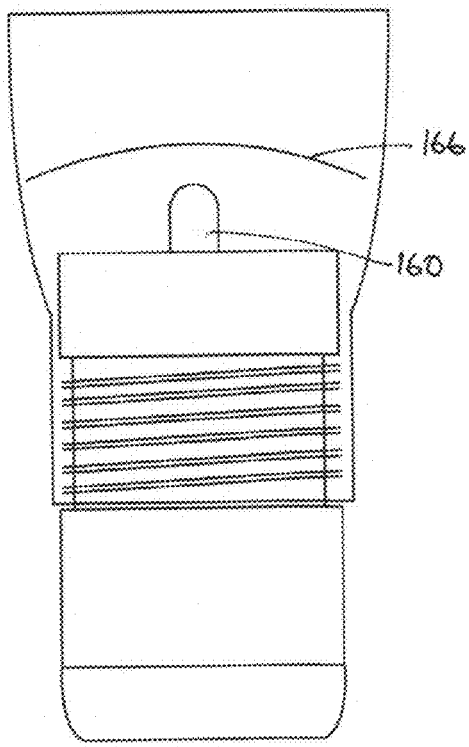

FIGS. 8A and 8B show yet a further embodiment of the invention. A light fixture 150 comprises a base housing 152 and a fixture shade 154 which can be attached thereto. The base housing 152 includes a cylindrical threaded portion 156, and a top surface 158 upon which is mounted a light source 160. The cylindrical threaded portion 156 has a male threaded portion. The fixture shade 154 includes a shade base 164 having an internal or female thread and an outer portion. As will be seen from these figures, the light fixture shade 154 can be screwed onto the base housing 152 at their commonly threaded areas. The fixture shade 154 includes a lens 166. The further the fixture shade 154 is screwed onto the base housing 152, the nearer the lens 166 will be to the light source 160. Conversely, the less that the fixture shade 154 is screwed onto the base housing 152, the more distant the lens 166 will be from the light source 160. The situation is in fact illustrated in FIGS. 8B and 8A respectively. As such, by appropriate placement and manipulation of the fixture shade 154 on the base housing 152, the nature of the light emanating from the light fixture 150 can be appropriately adjusted and controlled so that it may selectively be anything between a more focused beam and a more diffuse light.

Figure 9B:
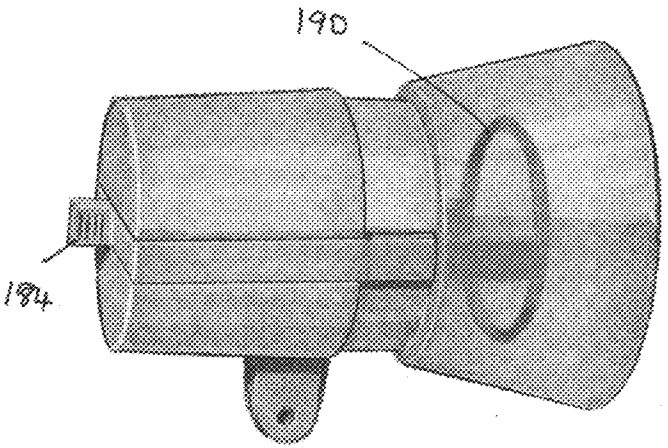
FIGS. 9A, 9B, 9C and 9D show a particular light fitting which may be used in the present invention including an integrated lens and frame constructed in accordance with the present invention.
Figure 9D:
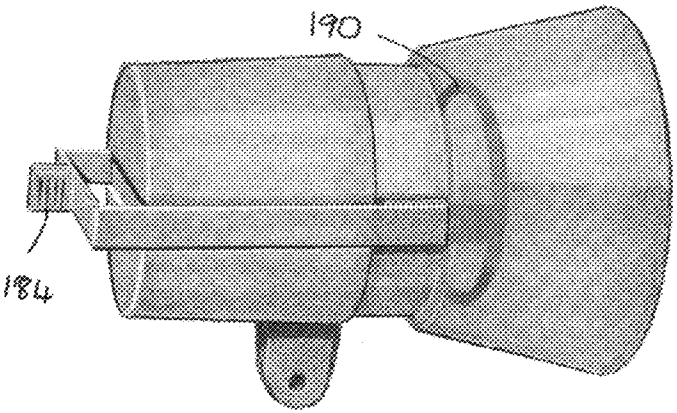
Figure 9A:
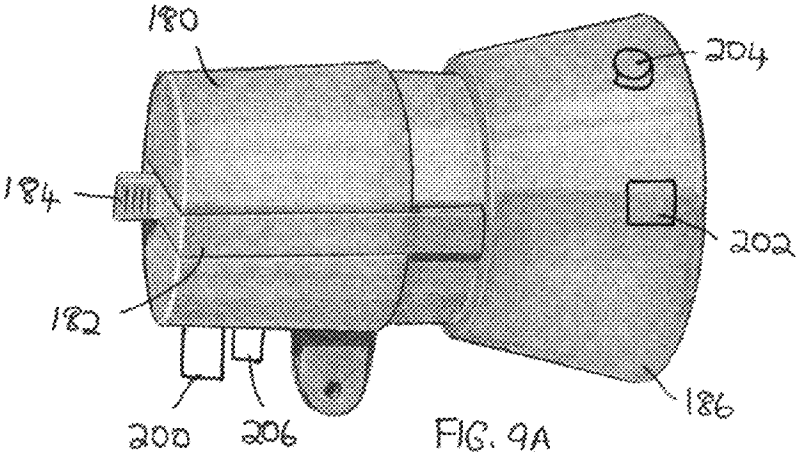
Figure 9C:
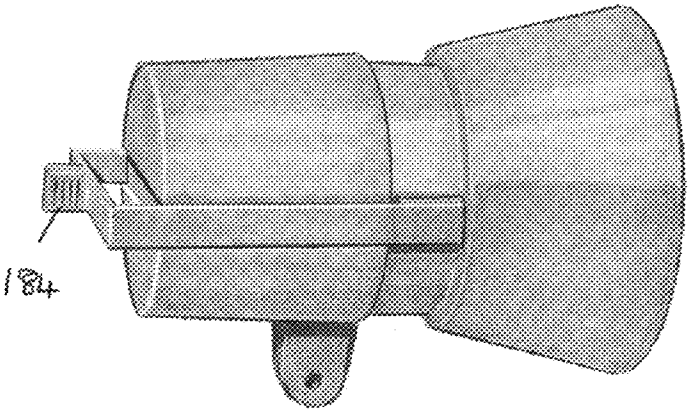

FIGS. 9A, 9B, 9C and 9D show another light fixture 180 of the present invention. FIGS. 9A and 9C show perspective side views, while FIGS. 9B and 9D R partially see-through to show the position of a lens in the light fixture at two respective positions. Part of the lens frame 182 with handle 184 can be seen mounted on the body 186 of the light fixture 180. The lens frame 182 can be moved axially back and forth, causing a lens 192 move closer to and further away respectively from the light source in the light fixture 180.

Figure 10:
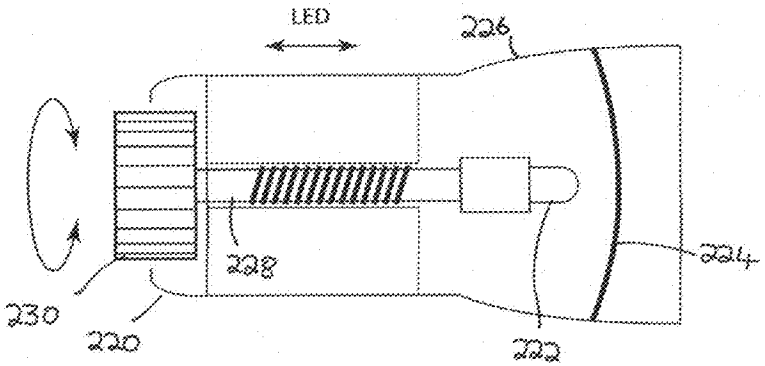
FIGS. 10, 11 and 12 show schematic side views of a light fitting of the invention wherein a dial and screw threaded component respectively move the light source, lens and reflector.

FIG. 10 of the drawings shows a light fitting 220 including a light source 222, a lens 224 and a reflector 226. The light source 222 is mounted on a threaded shaft 228, which has a rotatable knob 230. In this embodiment, rotation of the knob 230 has the effect of moving the light source 222 toward or away from the lens 224 to thereby adjust the nature of the beam emanating from the light fitting 220.

Figure 11:
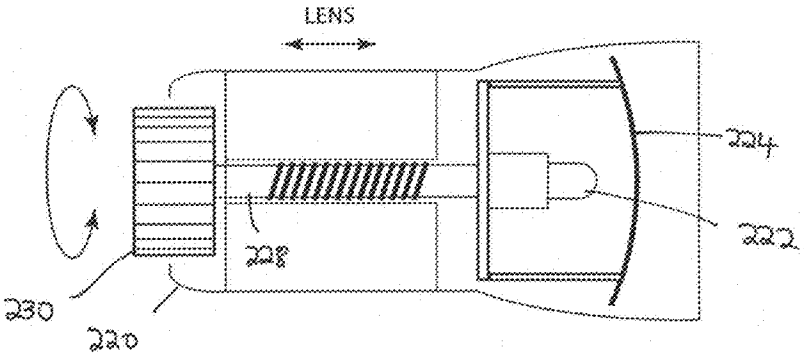
Figure 12:
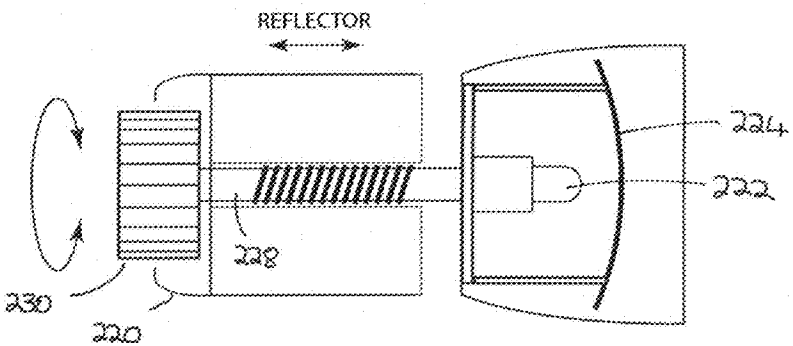

FIGS. 11 and 12 will now be briefly described. Although different embodiments from that shown in FIG. 10, similar corresponding reference numerals are used for the sake of convenience and more easily distinguishing and comparing each of the embodiments shown in FIGS. 10, 11 and 12.

FIG. 11 of the drawings shows a light fitting 220 including a light source 222, a lens 224 and a reflector 226. The lens 224 is mounted on a threaded shaft 228, which has a rotatable knob 230. In this embodiment, rotation of the knob 230 has the effect of moving the lens 224 toward or away from the light source 222 to thereby adjust the nature of the beam emanating from the light fitting 220.

FIG. 12 of the drawings shows a light fitting 220 including a light source 222, a lens 224 and a reflector 226. The reflector 226 is mounted on a threaded shaft 228, which has a rotatable knob 230. In this embodiment, rotation of the knob 230 has the effect of moving the reflector 226 toward or away from the lens 224 and/or light source 222 to thereby adjust the nature of the beam emanating from the light fitting 220.

Figure 13B:
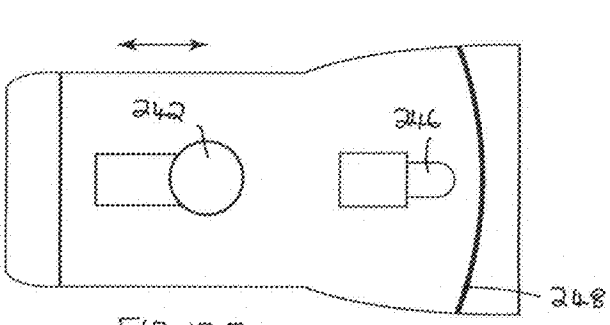
FIGS. 13A and 13B show schematic side views of a light fitting of the invention including a sliding button for moving the position of the light source.
Figure 14B:
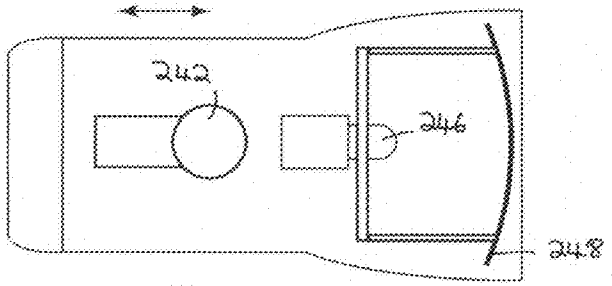
FIGS. 14A and 14B show schematic side views of a light fitting of the invention including a sliding button for moving the position of the lens.
Figure 15B:
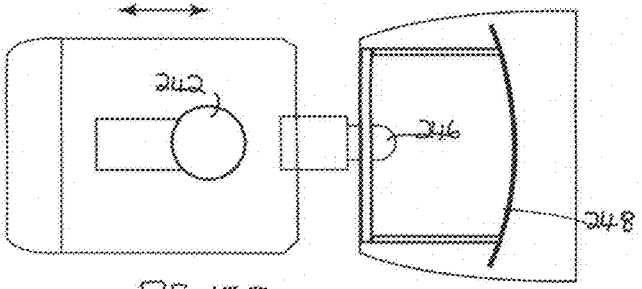
FIGS. 15A and 15B show schematic side views of a light fitting of the invention including a sliding button for moving the position of the reflector.
Figure 13A:
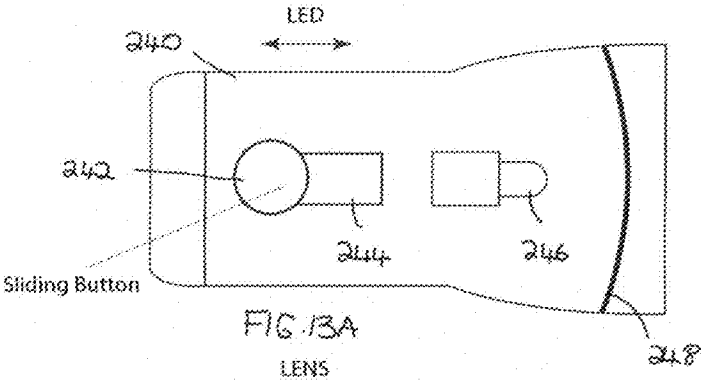
Figure 14A:
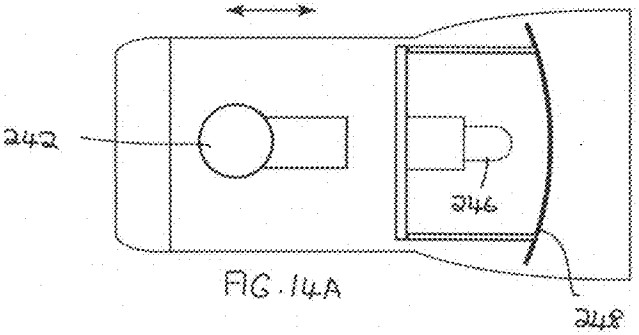
Figure 15A:
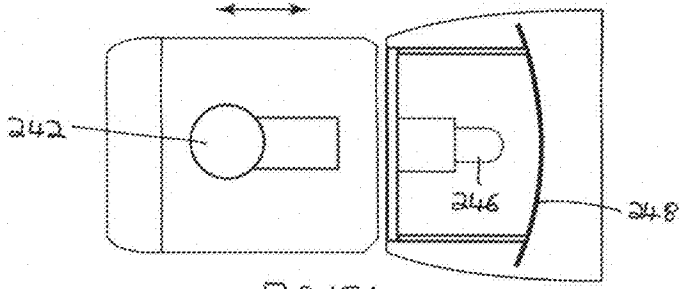

FIGS. 13A and 13B show a schematic representation of a light fixture 240 including a sliding button 242 and a slot 244 in which the sliding button 242 can move. The sliding button 242 is connected to the light source 246 so that appropriate movement of the sliding button 242 move the light source 246 nearer to, or further away from, the lens 248. FIGS. 14A and 14B show a similar arrangement, but one wherein the sliding button 242 is connected to the lens 248 to move it nearer to, or further away from, the light source 246. In FIGS. 15A and 15B, the sliding button is connected to the reflector 250 so as to move the reflector nearer to, or further away from, the light source 246. In all of these figures, appropriate movement of the sliding button 242 and the respective component to which it may be attached will have the effect of focusing or diffusing the light beam emanating from the light fixture, or anything intermediate these two allowable extremes.

It will be appreciated that the present invention may have various other features and characteristics. For example, the lens frame may be associated with a motor, represented schematically by reference numeral 200 in FIG. 9A of the drawings, which is operable so that the lens can be spaced at the desired position other than by the direct operation of an individual. In one form, the motor may be operable by a remote control, represented schematically by reference numeral 202 in FIG. 9A of the drawings. In another form of the invention, the light fixture or lens frame may be fitted with some form of motion sensor, represented schematically by reference numeral 204 in FIG. 9A of the drawings. When the motion sensor detects movement, the light fitting may have a control unit, represented schematically by reference numeral 206 in FIG. 9A of the drawings, which may be programmed to adjust the nature of the light by shifting the position of the lens, or in other embodiments, the position of the light source or the reflector, or a combination of two or more of these components. For example, the light fixture may generally shine a focused beam to illuminate a selected feature of a house or garden. However, when movement is detected, the lens may be moved in response thereto so as to provide a more diffuse or floodlit area to illuminate a pathway, for example, for the convenience of any person walking in that area. Many variations and possibilities of such an arrangement fall within the scope of are invention.

Any motor associated with the light fixture may have its own power source, or may share the power source with the light. The shared or individual power sources may be AC, battery, or solar energy power, or a combination of any two or more of these sources.

While several different embodiments showing various forms of association between the lens frame and the light fixture have been illustrated and described in the specification, the invention is not to be considered as limited to these methods of attachment. Any appropriate construction may be used within the scope of the invention which achieves the purpose of placing a lens adjacent a light source, and being able to selectively move the lens to multiple different positions relative to the light source in order to adjust the nature of the light provided by the light fixture. As already mentioned, the invention applies equally to a light source which is movable, or to a reflector which is movable, or to a combination thereof which may be independently movable with respect to each other.

The light fixture may be used indoors or outdoors, and may be powered by an AC power source, batteries, or solar energy. Of course, outdoor light fittings are more amenable to capture solar energy, and such an energy source would therefore be a desirable option in that context. Solar powered lighting devices in various embodiments of the present invention may also have alternative or additional power sources.

Other variations of the lighting device also fall within the scope of the invention. Thus, for example, a light fitting in accordance with the invention may have multiple light sources, some or all of which light sources are subject to the effects of the adjustable lens position as described above. Thus, one light source may be associated with the lens, while another will not. Moreover, if multiple light sources in a given fixture each have lenses associated therewith, each lens may be independently adjustable so that the light fixture may provide different variations of focused and diffused light.

The invention is not limited to the precise constructional details described. Any fixture having the parts and components which allow the nature of the light from a light source to be altered by associating a movable lens there with, and any mechanism for constructing such a fixture, will full within the scope of the present invention.

Throughout this description, the embodiments and examples shown should be considered as exemplars, rather than limitations on the apparatus and procedures disclosed or claimed. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A light fixture comprising:

a housing;

a light source located adjacent a reflector on or in the housing, a lens frame mounted substantially outside of the housing and movable relative to the housing, a lens on the lens frame, an adjustment member on the lens frame, the lens frame being movable relative to the housing by the adjustment member between a first position in which the lens is nearer the light source and reflector and a second position in which the lens is further away from the light source and reflector, wherein light produced by the light fixture is more focused or more diffuse according to the relative positions of the lens and the reflector and the light source.

2. A light fixture as claimed in claim 1 wherein the lens is movable and the light source is stationary.

3. A light fixture as claimed in claim 1 wherein the light source is movable and the lens is stationary.

4. A light fixture as claimed in claim 1 wherein both the lens and the light source or movable relative to each other.

5. A light fixture as claimed in claim 1 wherein the reflector is movable relative to at least one of the lens and the light source.

6. A light fixture as claimed in claim 1 wherein the lens is mounted in the lens frame, and the lens frame is movably mounted to the light housing, the light source being mounted on the light housing.

7. A light fixture as claimed in claim 1 wherein the lens frame is substantially cylindrical, the lens frame is mounted on a substantially cylindrical housing upon which the light source is mounted, the lens frame telescoping with respect to the cylindrical housing to facilitate an increase or decrease in the distance between the light source and the lens.

8. A light fixture as claimed in claim 1 wherein the lens frame threadedly engages a housing in or upon which the light source is mounted.

9. A light fixture as claimed in claim 8 wherein the lens frame has a male thread and the housing has a female thread.

10. A light fixture as claimed in claim 1 comprising a plurality of light sources each of which may be independently and separately moved relative to the lens.

11. A light fixture as claimed in claim 1 wherein the adjustment member has a handle portion which can be manipulated by the user to move the lens in the lens frame closer to or further from the light source.

12. A light fixture as claimed in claim 1 further comprising a pivotally rotatable handle, the rotatable handle having an end which engages in a recess formed within the adjustment member of the lens frame to mechanically move the lens frame nearer to or further away from the light source.

13. A light fixture as claimed in claim 1 further comprising: a motor for moving the lens frame and light source toward and away from each other; and a motion detector for sensing motion adjacent the light fixture, the motion detector facilitating the change in the nature of the light emanating from the light fixture in response to motion sensed.

14. A light fixture as claimed in claim 1 further comprising a shaft at least partially threaded and falling within a housing of the light fixture, the shaft being connected to an adjusting knob at one end thereof, the shaft being connected to one of the light source, lens or reflector at another end thereof.

* * * * *